US008554548B2

(12) United States Patent
Ehara

(10) Patent No.: US 8,554,548 B2
(45) Date of Patent: Oct. 8, 2013

(54) SPEECH DECODING APPARATUS AND SPEECH DECODING METHOD INCLUDING HIGH BAND EMPHASIS PROCESSING

(75) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1077 days.

(21) Appl. No.: 12/528,878

(22) PCT Filed: Feb. 29, 2008

(86) PCT No.: PCT/JP2008/000406

§ 371 (c)(1),
(2), (4) Date: Aug. 27, 2009

(87) PCT Pub. No.: WO2008/108082

PCT Pub. Date: Sep. 12, 2008

(65) Prior Publication Data

US 2010/0100373 A1 Apr. 22, 2010

(30) Foreign Application Priority Data

Mar. 2, 2007 (JP) ..... 2007-053531

(51) Int. Cl.
*G10L 19/08* (2013.01)

(52) U.S. Cl.
USPC ..... 704/219; 704/230; 704/223; 704/228; 375/240

(58) Field of Classification Search
USPC ..... 704/219, 223, 230, 207, 208, 228–229, 704/212, 233, 221, 200.1, 205, 500–504, 704/224; 375/350, 240
See application file for complete search history.

(56) References Cited

U.S. PATENT DOCUMENTS 5,857,168 A 1/1999 Ozawa
5,878,387 A * 3/1999 Oshikiri et al. ..... 704/207
6,058,360 A * 5/2000 Bergstrom ..... 704/219

(Continued)

FOREIGN PATENT DOCUMENTS

JP 9-281995 10/1997
JP 10-171497 6/1998

(Continued)

OTHER PUBLICATIONS

English language Abstract of JP 10-171497, Jun. 26, 1998.

(Continued)

*Primary Examiner* — Vijay B Chawan
(74) *Attorney, Agent, or Firm* — Greenblum & Bernstein, P.L.C.

(57) ABSTRACT

An audio decoding device can adjust the high-range emphasis degree in accordance with a background noise level. The audio decoding device includes: a sound source signal decoder which performs a decoding process by using sound source encoding data separated by a separator so as to obtain a sound source signal; an LPC synthesis filter which performs an LPC synthesis filtering process by using a sound source signal and an LPC generated by an LPC decoder so as to obtain a decoded sound signal; a mode judger which determines whether a decoded sound signal is a stationary noise period by using a decoded LSP inputted from the LPC decoder a power calculator which calculates the power of the decoded audio signal; an SNR calculator which calculates an SNR of the decoded audio signal by using the power of the decoded audio signal and a mode judgment result in the mode judger and a post filter which performs a post filtering process by using the SNR of the decoded audio signal.

5 Claims, 7 Drawing Sheets

(56) References Cited

U.S. PATENT DOCUMENTS

| | | | | |
|---|---|---|---|---|
| 6,092,041 | A * | 7/2000 | Pan et al. | 704/229 |
| 6,138,093 | A * | 10/2000 | Ekudden et al. | 704/228 |
| 6,240,383 | B1 * | 5/2001 | Tanaka | 704/219 |
| 6,377,915 | B1 * | 4/2002 | Sasaki | 704/206 |
| 6,385,573 | B1 | 5/2002 | Gao et al. | |
| 6,847,928 | B1 * | 1/2005 | Naka | 704/223 |
| 6,980,528 | B1 * | 12/2005 | LeBlanc et al. | 370/290 |
| 7,443,812 | B2 * | 10/2008 | Tackin et al. | 370/286 |
| 2002/0128829 | A1 * | 9/2002 | Yamaura et al. | 704/223 |
| 2004/0049380 | A1 * | 3/2004 | Ehara et al. | 704/219 |
| 2005/0187762 | A1 * | 8/2005 | Tanaka et al. | 704/220 |
| 2006/0080109 | A1 | 4/2006 | Kakuno et al. | |
| 2006/0116874 | A1 * | 6/2006 | Samuelsson et al. | 704/228 |
| 2007/0299669 | A1 | 12/2007 | Ehara | |
| 2008/0281587 | A1 | 11/2008 | Yoshida | |
| 2009/0018824 | A1 | 1/2009 | Teo | |

FOREIGN PATENT DOCUMENTS

| | | |
|---|---|---|
| JP | 2004-302258 | 10/2004 |
| WO | 2005/041170 | 5/2005 |
| WO | 2008/032828 | 3/2008 |

OTHER PUBLICATIONS

English language Abstract of JP 2004-302258, Oct. 28, 2004.
English language Abstract of JP 9-281995, Oct. 31, 1997.
Volodya Grancharov et al., "Noise-Dependent Postfiltering", Processing of IEEE International Conference on Acoustics, Speech, and Signal, 2004, May 17, 2004, vol. 1, pp. I-457-I-460.
Rainer Martin, "Noise Power Spectral Density Estimation Based on Optimal Smoothing and Minimum Statistics", IEEE Transactions on Speech and Audio Processing, Jul. 2001, vol. 9 No. 5, pp. 504-512.
Juin-Hwey Chen et al., "Adaptive Postfiltering for Quality Enhancement Coded Speech", IEEE Trans. on Speech and Audio Process. vol. 3, No. 1, Jan. 1995.
W. Bastiaan Kleijn, "Enhancement of Coded Speech by Constrained Optimization".
U.S. Appl. No. 12/529,212 to Oshikiri, filed Aug. 31, 2009.
U.S. Appl. No. 12/528,661 to Sato et al, filed Aug. 26, 2009.
U.S. Appl. No. 12/528,671 to Kawashima et al, filed Aug. 26, 2009.
U.S. Appl. No. 12/528,869 to Oshikiri et al, filed Aug. 27, 2009.
U.S. Appl. No. 12/528,877 to Morii et al, filed Aug. 27, 2009.
U.S. Appl. No. 12/529,219 to Morii et al, filed Aug. 31, 2009.
U.S. Appl. No. 12/528,871 to Morii et al, filed Aug. 27, 2009.
U.S. Appl. No. 12/528,659 to Oshikiri et al, filed Aug. 26, 2009.
U.S. Appl. No. 12/528,880 to Ehara, filed Aug. 27, 2009.
Grancharov V et al., "Noise-dependent postfiltering", Acoustics, Speech, and Signal Processing, 2004. Proceedings. (ICASSP '04). IEEE International Conference on Montreal, Quebec, Canada May 17-21, 2004, Piscataway, NJ, USA, IEEE, Piscataway, NJ, USA, vol. 1, 17, XP010717664, May 17, 2004, pp. 457-460.
Search report from E.P.O., mail date is Oct. 25, 2011.

* cited by examiner

SPEECH DECODING APPARATUS AND SPEECH DECODING METHOD INCLUDING HIGH BAND EMPHASIS PROCESSING

TECHNICAL FIELD

The present invention relates to a speech decoding apparatus and speech decoding method of a CELP (Code-Excited Linear Prediction) scheme. More particularly, the present invention relates to a speech decoding apparatus and speech decoding method for compensating quantization noise in accordance with human perceptual characteristics and improving the subjective quality of decoded speech signals.

BACKGROUND ART

CELP type speech codec often uses a post filter to improve the subjective quality of decoded speech (for example, see Non-Patent Document 1). The post filter in Non-Patent Document 1 is based on serial connection of three filters of formant emphasis post filter, pitch emphasis post filter and spectrum tilt compensation (or high band enhancement) filter. The formant emphasis filter makes the valleys in the spectrum of a speech signal steeper, and thereby provides an effect of making quantization noise, which exists in the valley portion of the spectrum, hard to hear. The pitch emphasis post filter makes the valleys in the spectral harmonics of a speech signal steeper, and thereby provides an effect of making quantization noise, which exists in the valley portion of the harmonics, hard to hear. The spectral tilt compensation filter mainly plays a role of restoring the spectral tilt, which is modified by the formant emphasis filter, to the original tilt. For example, if the higher band is attenuated by the formant emphasis filter, the spectral tilt compensation filter performs high-band emphasis.

On the other hand, in a decoded signal in CELP type speech codec, components of higher frequency are more likely to be attenuated. This is because waveforms matching is more difficult for signal waveforms of high frequencies than signal waveforms of low frequencies. This energy attenuation of the high-band components of a decoded signal gives to listeners an impression that the band of the decoded signal is narrowed, and this causes the degradation of subjective quality of the decoded signal.

To solve the above-described problem, a technique of performing a tilt compensation of decoded excitation signals is suggested as post processing for decoded excitation signals (e.g. see Patent Document 1). With this technique, the tilt of a decoded excitation signal is compensated based on the spectral tilt of the decoded excitation signal such that the spectrum of the decoded signal becomes flat.

However, if high-band emphasis is performed excessively upon performing tilt compensation of the speech excitation signals as post processing for decoded excitation signals, quantization noise, which exists in the higher band, is perceivable, which may degrade subjective quality. Whether this quantization noise is perceived as degradation of subjective quality depends on the features of a decoded signal or input signal. For example, if the decoded signal is a clean speech signal without background noise, that is, if the input signal is such a speech signal, quantization noise in the higher band amplified by high-band emphasis is relatively more perceivable. By contrast, if the decoded signal is a speech signal with high-level background noise, that is, if the input signal is such a speech signal, quantization noise in the higher band amplified by high-band emphasis is masked by the background noise and is therefore relatively hard to be perceived. By this means, if the background noise level is high and high-band emphasis is too little, giving an impression of a narrowed band is likely to cause the degradation of subjective quality, and therefore sufficient high-band emphasis needs to be performed.

Non-Patent Document 1: J-H. Chen and A. Gersho, "Adaptive Postfiltering for Quality Enhancement of Coded Speech," IEEE Trans. on Speech and Audio Process. vol. 3, no. 1, January 1995

Patent Document 1: U.S. Pat. No. 6,385,573

DISCLOSURE OF INVENTION

Problems to be Solved by the Invention

However, in the high-band emphasis disclosed in Patent Document 1, which means tilt compensation processing of decoded excitation signals, although the level of tilt compensation is determined based on the spectral tilt of a decoded excitation signal, this processing does not take into account the fact that the allowable level of tilt compensation changes based on the magnitude of the background noise level.

It is therefore an object of the present invention to provide a speech decoding apparatus and speech decoding method that can adjust the level of high-band emphasis based on the magnitude of the background noise level, upon performing tilt compensation of decoded signals as post processing for decoded excitation signals.

Means for Solving the Problem

The speech decoding apparatus of the present invention employs a configuration having: a speech decoding section that decodes encoded data acquired by encoding a speech signal to acquire a decoded speech signal; a mode deciding section that decides, at regular intervals, whether or not a mode of the decoded speech signal comprises a stationary noise period; a power calculating section that calculates a power of the decoded speech signal; a signal to noise ratio calculating section that calculates a signal to noise ratio of the decoded speech signal using a mode decision result in the mode deciding section and the power of the decoded speech signal; and a post filtering section that performs post filtering processing including high band emphasis processing of an excitation signal, using the signal to noise ratio.

The speech decoding method of the present invention includes the steps of: decoding encoded data acquired by encoding a speech signal to acquire a decoded speech signal; deciding, at regular intervals, whether or not a mode of the decoded speech signal comprises a stationary noise period; calculating a power of the decoded speech signal; calculating a signal to noise ratio of the decoded speech signal using a mode decision result in the mode deciding section and the power of the decoded speech signal; and performing post filtering processing including high band emphasis processing of an excitation signal, using the signal to noise ratio.

Advantageous Effects of Invention

According to the present invention, upon performing tilt compensation of decoded excitation signals as post processing for decoded excitation signals, by calculating coefficients for high-band emphasis processing of weighted linear prediction residual signals based on the SNR of decoded speech signals and adjusting the level of high-band emphasis based on the magnitude of the background noise level, it is possible to improve the subjective quality of speech signals to output.

BEST MODE FOR CARRYING OUT THE INVENTION

An embodiment of the present invention will be explained below in detail with reference to the accompanying drawings.

Figure 1:
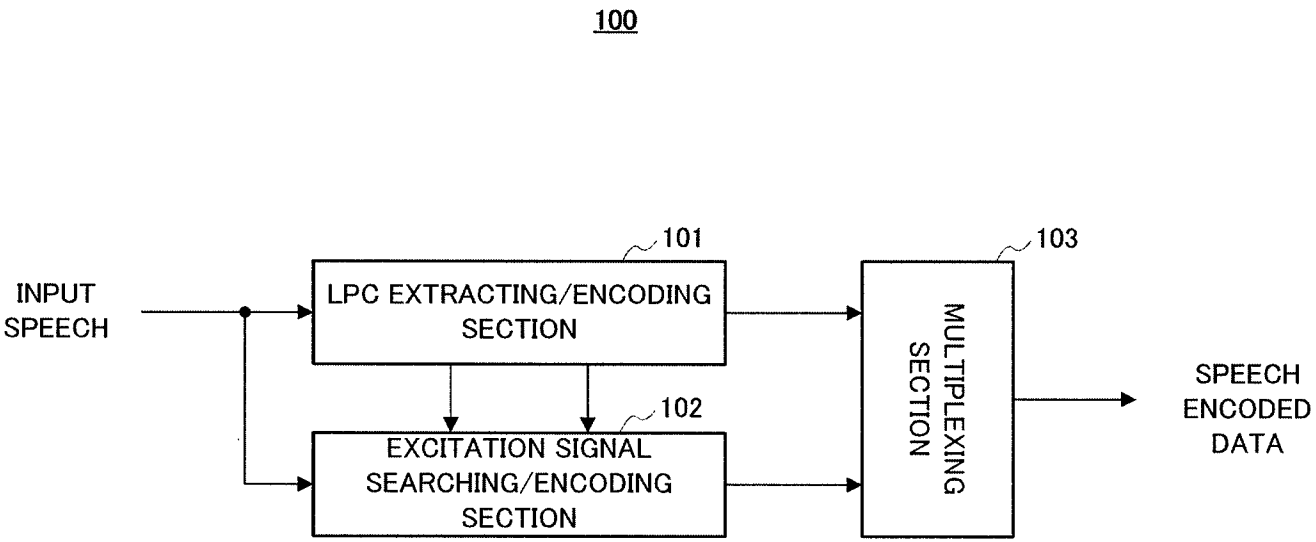
FIG. 1 is a block diagram showing the main components of a speech encoding apparatus according to an embodiment of the present invention.

FIG. 1 is a block diagram showing the main components of speech encoding apparatus according to an embodiment of the present invention.

In FIG. 1, speech encoding apparatus 100 is provided with LPC extracting/encoding section 101, excitation signal searching/encoding section 102 and multiplexing section 103.

LPC extracting/encoding section 101 performs a linear prediction analysis of an input speech signal, to extract the linear prediction coefficients ("LPC's") and outputs the acquired LPC's to excitation signal searching/encoding section 102. Further, LPC extracting/encoding section 101 quantizes and encodes the LPC's, and outputs the quantized LPC's to excitation signal searching/encoding section 102 and the LPC encoded data to multiplexing section 103.

Excitation signal searching/encoding section 102 performs filtering processing of the input speech signal, using a perceptual weighting filter with filter coefficients acquired by multiplying the LPC's received as input from LPC extracting/encoding section 101 by weighting coefficients, thereby acquiring a perceptually weighted input speech signal. Further, excitation signal searching/encoding section 102 acquires a decoded signal by performing filtering processing of an excitation signal generated separately, using an LPC synthesis filter with the quantized LPC's as filter coefficients, and acquires a perceptually weighted synthesis signal by further applying the decoded signal to the perceptual weighting filter. Here, excitation signal searching/encoding section 102 searches for the excitation signal to minimize a residual signal between the perceptually weighted synthesis signal and the perceptually weighted input speech signal, and outputs information indicating the excitation signal specified by the search, to multiplexing section 103 as excitation encoded data.

Multiplexing section 103 multiplexes the LPC encoded data received as input from LPC extracting/encoding section 101 and the excitation encoded data received as input from excitation signal searching/encoding section 102, further performs processing such as channel encoding for the resulting speech encoded data, and outputs the result to a transmission channel.

Figure 2:
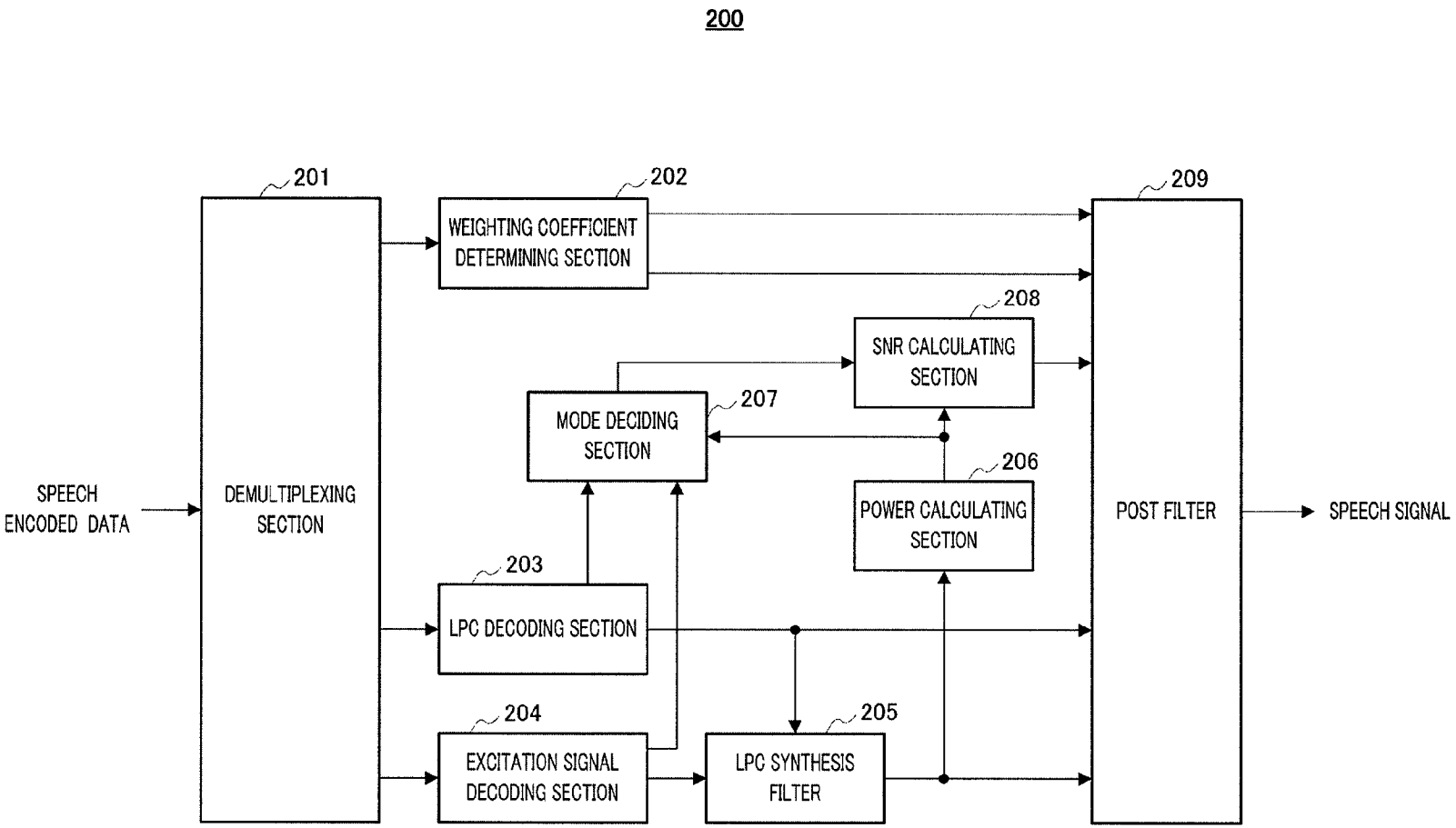
FIG. 2 is a block diagram showing the main components of a speech decoding apparatus according to an embodiment of the present invention.

FIG. 2 is a block diagram showing the main components of speech decoding apparatus 200 according to the present embodiment.

In FIG. 2, speech decoding apparatus 200 is provided with demultiplexing section 201, weighting coefficient determining section 202, LPC decoding section 203, excitation signal decoding section 204, LPC synthesis filter 205, power calculating section 206, mode deciding section 207, SNR calculating section 208 and post filter 209.

Demultiplexing section 201 demultiplexes the speech encoded data transmitted from speech encoding apparatus 100, into information about coding bit rate (i.e. bit rate information), LPC encoded data and excitation encoded data, and outputs these to weighting coefficient determining section 202, LPC decoding section 203 and excitation signal decoding section 204, respectively.

Weighting coefficient determining section 202 calculates or selects the first weighting coefficient $\gamma 1$ and second weighting coefficient $\gamma 2$ for post filtering processing, based on the bit rate information received as input from demultiplexing section 201, and outputs these to post filter 209. The first weighting coefficient $\gamma 1$ and second weighting coefficient $\gamma 2$ will be described later in detail.

LPC decoding section 203 performs decoding processing using the LPC encoded data received as input from demultiplexing section 201, and outputs the resulting LPC's to LPC synthesis filter 205 and post filter 209. Here, assume that the quantization and encoding of LPC's in speech encoding apparatus 100 are performed by quantizing and encoding LSP's (Line Spectrum Pairs or Line Spectral Pairs, which are also referred to as LSF's (Line Spectrum Frequencies or Line Spectral Frequencies)) associated with the LPC's on a per one-to-one basis. In this case, LPC decoding section 203 acquires quantized LSP's in decoding processing first, transforms these into LPC's to acquire quantized LPC's. LPC decoding section 203 outputs the decoded, quantized LSP's to (hereinafter "decoded LSP's") to mode deciding section 207.

Excitation signal decoding section 204 performs decoding processing using the excitation encoded data received as input from demultiplexing section 201, outputs the resulting decoded excitation signal to LPC synthesis filter 205 and outputs a decoded pitch lag and decoded pitch gain, which are acquired in the decoding process of the decoded excitation signal, to mode deciding section 207.

LPC synthesis filter 205 is a linear prediction filter having the decoded LPC's received as input from LPC decoding section 203 as filter coefficients, and performs filtering processing of the excitation signal received as input from excitation signal decoding section 204 and outputs the resulting decoded speech signal to power calculating section 206 and post filter 209.

Power calculating section 206 calculates the power of the decoded speech signal received as input from LPC synthesis filter 205 and outputs it to mode deciding section 207 and SNR calculating section 208. Here, the power of the decoded signal is the value representing the average value of the square sum of the decoded speech signal per sample, by decibel (dB). That is, when the average value of the square sum of the decoded signal per sample is expressed using "X," the power of the decoded speech signal expressed by decibel is 10 $\log_{10}X$.

Using the decoded LSP's received as input from LPC decoding section 203, the pitch flag and decoded pitch gain received as input from excitation signal decoding section 204 and the decoded speech signal power received as input from power calculating section 206, mode deciding section 207 decides whether or not the decoded speech signal is a stationary noise period signal, based on the following criteria (a) to (f), and outputs the decision result to SNR calculating section 208. That is, mode deciding section 207: (a) decides that the decoded speech signal is not a stationary noise period if the variation of decoded LSP's in a predetermined time period is equal to or greater than a predetermined level; (b) decides that the decoded speech signal is not a stationary noise period if the distance between the average value of decoded LSP's in a period decided as a stationary noise period in the past, and the decoded LSP's received as input from LPC decoding section 203; (c) decides that the decoded speech signal is not a stationary noise period if the decoded pitch gain received as input from excitation signal decoding section 204 or the value acquired by smoothing this pitch gain in the time domain is equal to or greater than a predetermined value; (d) decides that the decoded speech signal is not a stationary noise period if the similarity between a plurality of decoded pitch lags received as input from excitation signal decoding section 204 in a predetermined past time period, is equal to or greater than a predetermined level; (e) decides that the decoded speech signal is not a stationary noise period if the decoded excitation signal power received as input from power calculating section 206 increases at the rising rate equal to or more than a predetermined threshold, compared to the past; and (f) decides that the decided speech signal is not a stationary noise period if the interval between adjacent decoded LSP's received as input from LPC decoding section 203 is narrower than a predetermined threshold and there is a steep spectral peak. Using these decision criteria, mode deciding section 207 detects a stationary period of a decoded speech signal (e.g. by using criterion (a)), excludes non-noise periods such as a voiced stationary portion of a speech signal from the detected stationary period (e.g. by using criteria (c) and (d)) and further excludes non-stationary periods (e.g. by using criteria (b), (e) and (f)), thereby acquiring a stationary period.

Signal to Noise Ratio (SNR) calculating section 208 calculates the SNR of a decoded excitation signal using the decoded excitation signal power received as input from power calculating section 206 and the mode decision result received as input from mode deciding section 207, and outputs it to post filter 209. The configuration and operations of SNR calculating section 208 will be described later in detail.

Post filter 209 performs post filtering processing using the first weighting coefficient γ1 and second weighting coefficient γ2 received as input from weighting coefficient determining section 202, the LPC's received as input from LPC decoding section 203, the decoded speech signal received as input from LPC synthesis filter 205 and the SNR received as input from SNR calculating section 208, and outputs the resulting speech signal. The post filtering processing in post filter 209 will be described later in detail.

Figure 3:
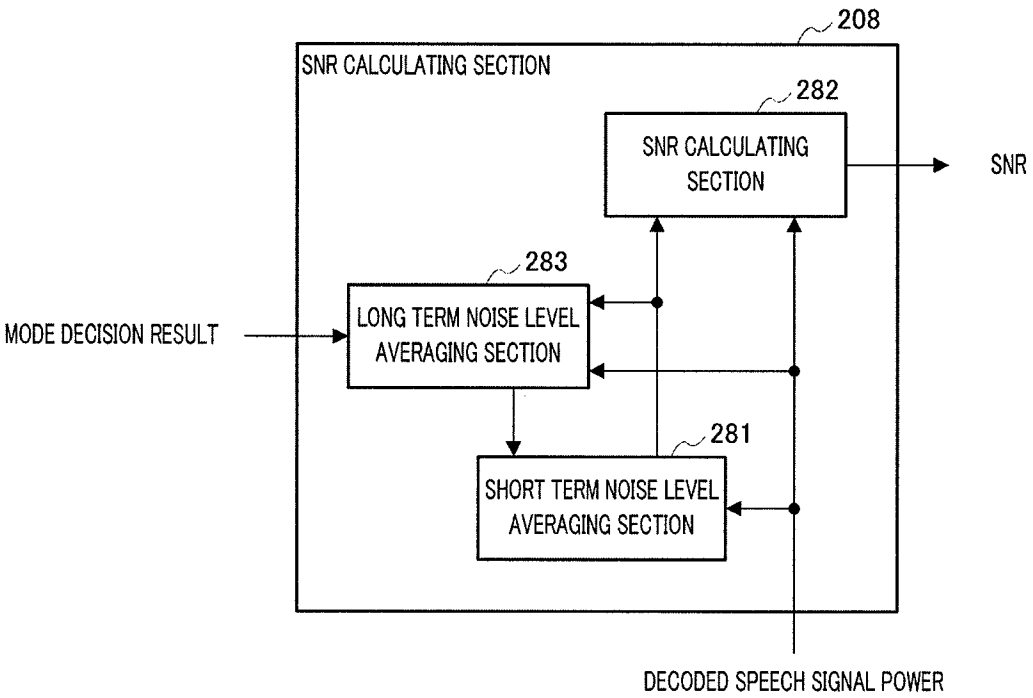
FIG. 3 is a block diagram showing the configuration inside a SNR calculating section according to an embodiment of the present invention.

FIG. 3 is a block diagram showing the configuration inside SNR calculating section 208.

In FIG. 3, SNR calculating section 208 is provided with short term noise level averaging section 281, SNR calculating section 282 and long term noise level averaging section 283.

If the decoded speech signal power in the current frame received as input from power calculating section 206 is lower than the noise level received as input from long term noise level averaging section 282, short term noise level averaging section 281 updates the noise level using the decoded speech signal power in the current frame and the noise level, according to following equation 1. Short term noise level averaging section 281 then outputs the updated noise level to long term noise level averaging section 283 and SNR calculating section 282. Further, if the decoded speech signal power in the current frame is equal to or higher than the noise level, short term noise level averaging section 281 outputs the input noise level without updating, to long term noise level averaging section 283 and SNR calculating section 282. Here, short term noise level averaging section 281 is directed to deciding that the reliability of the noise level is low when the decoded speech signal power received as input is lower than the noise level, and updating the noise level by the short-term average of the decoded speech signal such that the decoded speech signal power received as input is more likely to be reflected to the noise level. Therefore, the coefficient in equation 1 is not limited to 0.5, and the essential requirement is that the coefficient is lower than the coefficient of 0.9375 that is used in long term noise level averaging section 283 in equation 2. By this means, the current decoded speech signal power is more likely to be reflected than the long-term average noise level calculated in long term noise level averaging section 283, thereby allowing the noise level to approach the current decoded speech signal power quickly.

$$\text{(noise level)}=0.5\times\text{(noise level)}+0.5\times\text{(decoded speech signal power in the current frame)} \quad \text{(Equation 1)}$$

SNR calculating section 282 calculates the difference between the decoded speech signal power received as input from power calculating section 206 and the noise level received as input from short term noise level averaging section 281, and outputs the result to post filter 209 as the SNR of the decoded speech signal. Here, the decoded speech signal power and the noise level are values expressed by decibel, and therefore the SNR is acquired by calculating the difference between them.

If the mode decision result received as input from mode deciding section 207 shows a stationary noise period or the decoded speech signal power in the current frame is lower than a predetermined threshold, long term noise level averaging section 283 updates the noise level using the decoded speech signal power in the current frame and the noise level received as input from short term noise level averaging section 281, according to following equation 2. Long term noise level averaging section 283 then outputs the updated noise level to short term noise level averaging section 281 as the noise level in the processing of the next frame. Further, if the mode decision result does not show a stationary noise period and the decoded speech signal power in the current frame received as input from power calculating section 206 is equal to or higher than a predetermined threshold, long term noise level averaging section 283 does not update the noise level received as input and outputs it as is, to short term noise level averaging section 281, as the noise level to be used in the processing of the next frame. Here, long term noise level averaging section 283 is directed to calculating a long-term average of the decoded speech signal power in a noise period or silence period. Therefore, the coefficient in equation 2 is not limited to 0.9375, and is set to a value over 0.9 and close to 1.0. Here, 0.9375 is equal to $15/16$, which is a value not causing error in fixed-point arithmetic.

$$\text{(noise level)}=0.9375\times\text{(noise level)}+(1-0.9375)\times\text{(decoded speech signal power in the current frame)} \quad \text{(Equation 2)}$$

Figure 4:
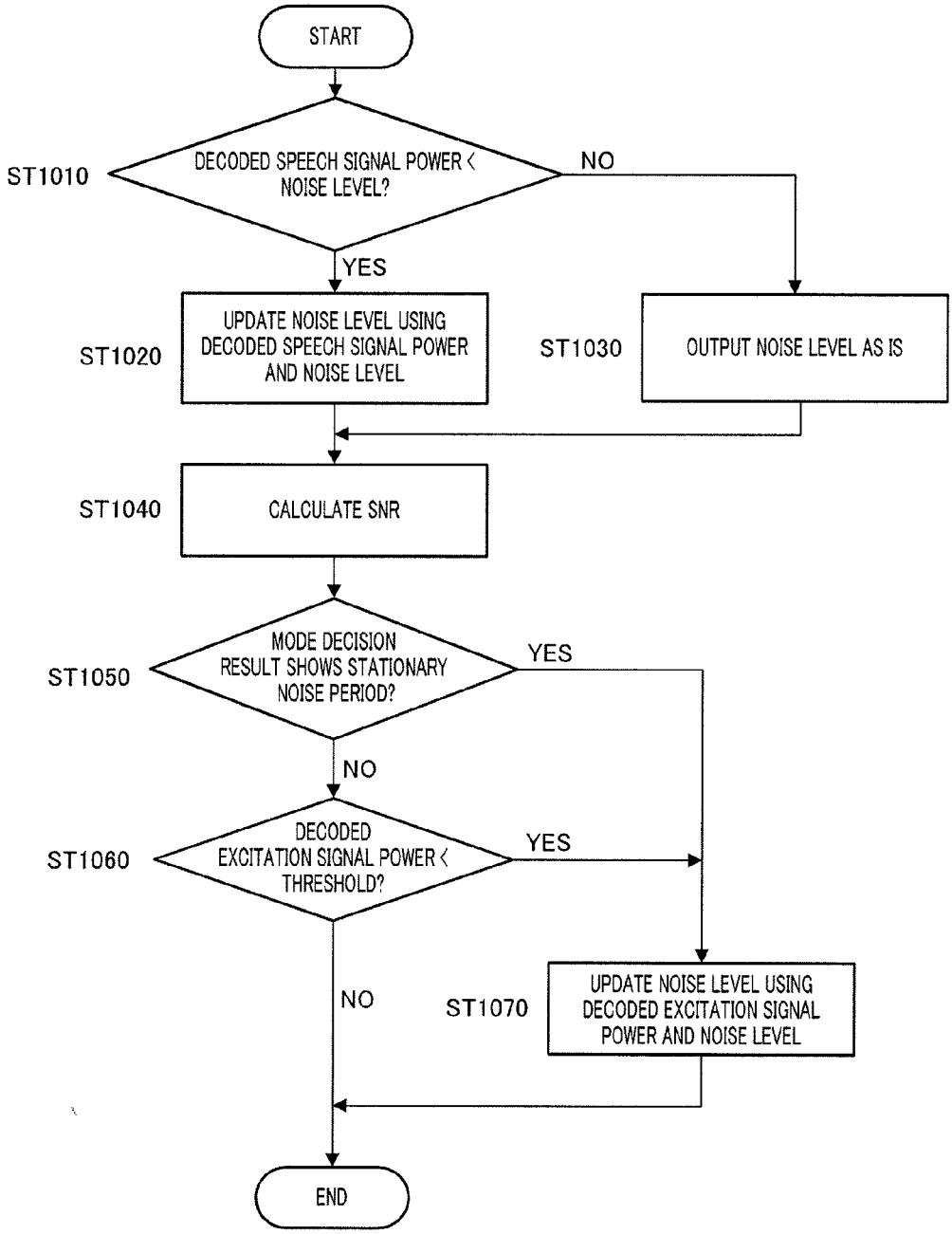
FIG. 4 is a flowchart showing the steps of calculating the SNR of a decoded speech signal in a SNR calculating section according to an embodiment of the present invention.

FIG. 4 is a flowchart showing the steps of calculating the SNR of a decoded speech signal in SNR calculating section 208.

First, in step (hereinafter "ST") 1010, short term noise level averaging section 281 decides whether or not the decoded speech signal power received as input from power calculating section 206 is lower than the noise level received as input from long term noise level averaging section 283.

When it is decided that the decoded speech signal power is lower than the noise level in ST 1010 (i.e. "YES" in ST 1010), in ST 1020, short term noise level averaging section 281 updates the noise level using the decoded speech signal power and the noise level, according to equation 1.

By contrast, in ST 1010, if the decoded speech signal power is equal to or higher than the noise level in ST 1010 (i.e. "NO" in ST 1010), in ST 1030, short term noise level averaging section 281 does not update the noise level and outputs it as is.

Next, in ST 1040, SNR calculating section 282 calculates, as a SNR, the difference between the decoded speech signal power received as input from power calculating section 206 and the noise level received as input from short term noise level averaging section 281.

Next, in ST 1050, long term noise level averaging section 283 decides whether or not the mode decision result received as input from mode deciding section 207 shows a stationary noise period.

When it is decided that the mode decision result does not show a stationary noise period in ST 1050 (i.e. "NO" in ST 1050), in ST 1060, long term noise level averaging section 283 decides whether or not the decoded speech signal power is lower than a predetermined threshold.

When it is decided that the decoded speech signal power is equal to or higher than a predetermined threshold in ST 1060 (i.e. "NO" in ST 1060), long term noise level averaging section 283 does not update the noise level.

By contrast, when it is decided that the mode decision result shows a stationary noise period in ST 1050 (i.e. "YES" in ST 1050) or if the decoded speech signal power is lower than a predetermined threshold in ST 1060 (i.e. "YES" in ST 1060), in ST 1070, long term noise level averaging section 283 updates the noise level using the decoded speech signal power and the noise level, according to equation 2.

Figure 5:
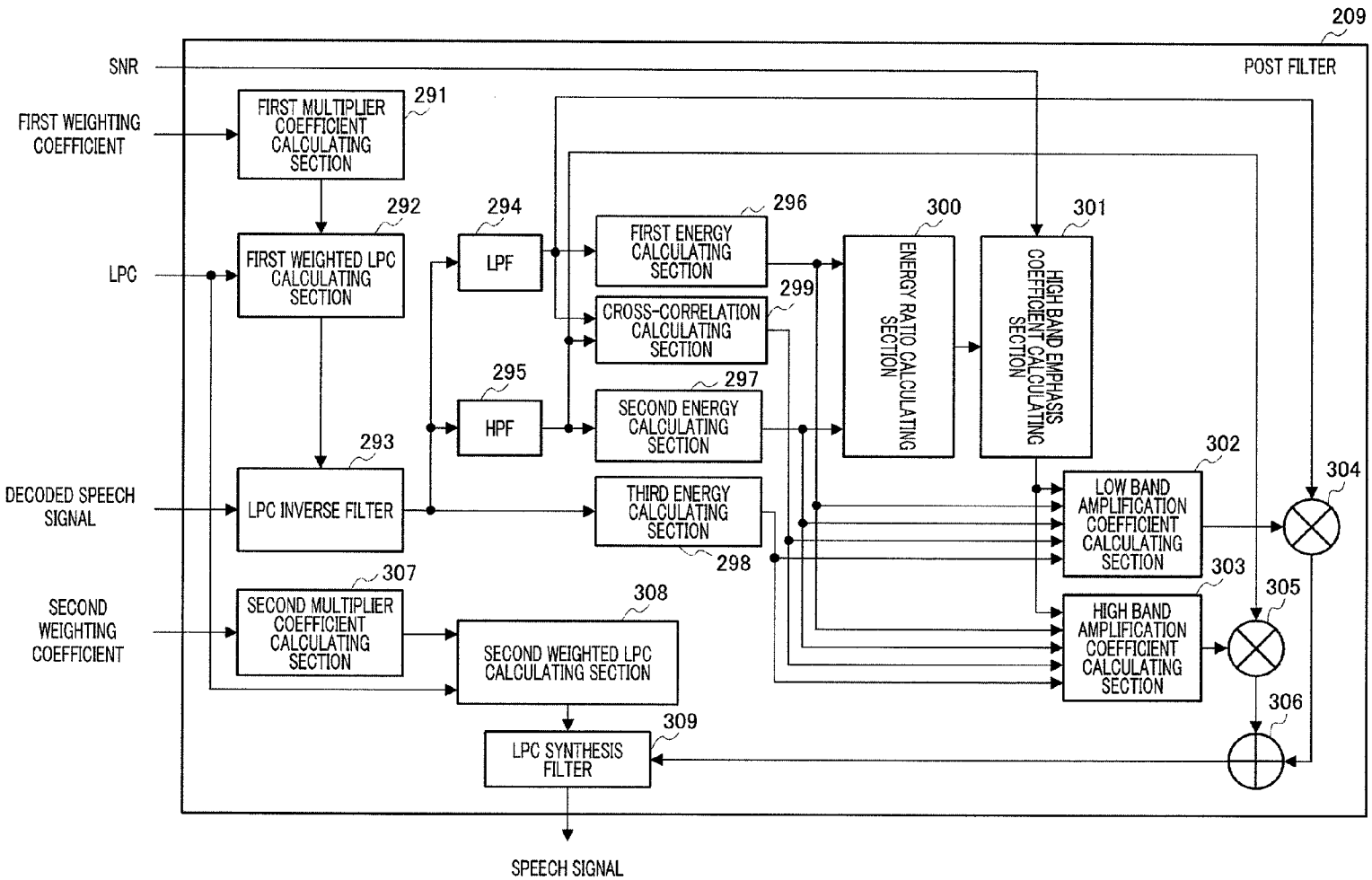
FIG. 5 is a block diagram showing the configuration inside a post filter according to an embodiment of the present invention.

FIG. 5 is a block diagram showing the configuration inside post filter 209.

In FIG. 5, post filter 209 is provided with first multiplier coefficient calculating section 291, first weighted LPC calculating section 292, LPC inverse filter 293, Low Pass Filter (LPF) 294, High Pass Filter (HPF) 295, first energy calculating section 296, second energy calculating section 297, third energy calculating section 298, cross-correlation calculating section 299, energy ratio calculating section 300, high-band emphasis coefficient calculating section 301, low band amplification coefficient calculating section 302, high band amplification coefficient calculating section 303, multiplier 304, multiplier 305, adder 306, second multiplier coefficient calculating section 307, second weighted LPC calculating section 308 and LPC synthesis filter 309.

First multiplier coefficient calculating section 291 calculates coefficient $\beta_1^j$, by which the linear prediction coefficient of the j-th order is multiplied, using the first weighing coefficient $\gamma_1$ received as input from weighing coefficient determining section 202, and outputs the result to first weighted LPC calculating section 292 as the first multiplier coefficient. Here, $\gamma_1^j$ is calculated by calculating the j-th power of $\gamma_1$, where $0 \leq \gamma_1 \leq 1$.

First weighted LPC calculating section 292 multiplies the LPC of the j-th order received as input from LPC decoding section 203 by the first multiplier coefficient $\gamma_1^j$ received as input from first multiplier coefficient calculating section 291, and outputs the multiplying result to LPC inverse filter 293 as the first weighted LPC.

LPC inverse filter 293 is a linear prediction inverse filter, in which the transfer function is expressed by $Hi(z)=1+\Sigma^{M}_{j=1}a_{j1}\times z^{-j}$, and performs filtering processing of the decoded speech signal received as input from LPC synthesis filter 205, and outputs the resulting weighted linear prediction residual signal to LPF 294, HPF 295 and third energy calculating section 298. Here, $a_{j1}$ represents the first weighted LPC of the j-th order received as input from first weighted LPC calculating section 292.

LPF 294 is a linear-phase low pass filter, and extracts the low band components of weighted linear prediction residual signal received as input from LPC inverse filter 293 and outputs these to first energy calculating section 296, cross-correlation calculating section 299 and multiplier 304. HPF 295 is a linear-phase high pass filter, and extracts the high band components of weighted linear prediction residual signal received as input from LPC inverse filter 293 and outputs these to second energy calculating section 297, cross-correlation calculating section 299 and multiplier 305. Here, there is a relationship that the signal acquired by adding the output signal of LPF 294 and the output signal of HPF 295 matches the output signal of LPC inverse filter 293. Further, both LPF 294 and HPF 295 are filters with moderate blocking characteristics, and, for example, are designed to leave some low band components in the output signal of HPF 295.

First energy calculating section 296 calculates the energy of the low band components of the weighted linear prediction residual signal received as input from LPF 294, and outputs the energy to energy ratio calculating section 300, low band amplification coefficient calculating section 302 and high band amplification coefficient calculating section 303.

Second energy calculating section 297 calculates the energy of the high band components of the weighted linear prediction residual signal received as input from HPF 295, and outputs the energy to energy ratio calculating section 300, low band amplification coefficient calculating section 302 and high band amplification coefficient calculating section 303.

Third energy calculating section 298 calculates the energy of the weighted linear prediction residual signal received as input from LPC inverse filter 293, and outputs it to low band amplification coefficient calculating section 302 and high band amplification coefficient calculating section 303.

Cross-correlation calculating section 299 calculates the cross-correlation between the low band components of the weighted linear prediction residual signal received as input from LPF 294 and the high band components of the weighted linear prediction residual signal received as input from HPF 295, and outputs the result to low band amplification coefficient calculating section 302 and high band amplification coefficient calculating section 303.

Energy ratio calculating section 300 calculates the ratio between the energy of the low band components of the weighted linear prediction residual signal received as input from first energy calculating section 296 and the energy of the high band components of the weighted linear prediction residual signal received as input from second energy calculating section 297, and outputs the result to high band emphasis coefficient calculating section 301 as energy ratio ER. The energy ratio "ER" is calculated by the equation $ER=10(\log_{10}EL-\log_{10}EH)$, and expressed in the decibel unit. Here, EL represents the energy of low band components, and EH represents the energy of high band components.

High band emphasis coefficient calculating section 301 calculates the high band emphasis coefficient R using the energy ratio ER received as input from energy ratio calculating section 300 and the SNR received as input from SNR calculating section 208, and outputs the result to low band amplification coefficient calculating section 302 and high band amplification coefficient calculating section 303. Here, the high band emphasis coefficient R is a coefficient defined as the energy ratio between the low band components and high band components of a high band emphasis-processed linear prediction residual signal. That is, the high band emphasis coefficient R means a value of the desired energy ratio between the low band components and the high band components after performing high band emphasis.

Using the high band emphasis coefficient R received as input from high band emphasis coefficient calculating section 301, the energy of the low band components of weighted linear prediction residual signal received as input from first energy calculating section 296, the energy of high band components of the weighted linear prediction residual signal received as input from second energy calculating section 297, the energy of the weighted linear prediction residual signal received as input from third energy calculating section 298 and the cross-correlation received as input from cross-correlation calculating section 299 between the high band components and low band components of the weighted linear prediction residual signal, low band amplification coefficient calculating section 302 calculates the low band amplification coefficient β according to following equation 3 and outputs it to multiplier 304.

[1]

$$\beta = \sqrt{\frac{\sum_i |eh[i]|^2 |ex[i]|^2}{\left(1 + 10^{\frac{-R}{10}}\right)\sum_i |el[i]|^2 \sum_i |eh[i]|^2 + 2\sum_i (el[i] \times eh[i]) \sqrt{10^{\frac{-R}{10}} \sum_i |el[i]|^2 \sum_i |eh[i]|^2}}} \quad \text{(Equation 3)}$$

In equation 3, "i" represents the sample number, ex[i] represents the excitation signal before high band emphasis processing (i.e. weighted linear prediction residual signal), eh[i] represents the high band components of ex[i] and el[i] represents the low band components of ex[i] (same as below).

Using the high band emphasis coefficient R received as input from high band emphasis coefficient calculating section 301, the energy of the low band components of the weighted linear prediction residual signal received as input from first energy calculating section 296, the energy of the high band components of the weighted linear prediction residual signal received as input from second energy calculating section 297, the energy of the weighted linear prediction residual signal received as input from third energy calculating section 298 and the cross-correlation received as input from cross-correlation calculating section 299 between the high band components and low band components of the weighted linear prediction residual signal, high band amplification coefficient calculating section 303 calculates the high band amplification coefficient α according to following equation 4 and outputs it to multiplier 305. Equation 4 will be described later in detail.

[2]

$$\alpha = \sqrt{\frac{\sum_i |el[i]|^2 |ex[i]|^2}{\left(1 + 10^{\frac{R}{10}}\right)\sum_i |el[i]|^2 \sum_i |eh[i]|^2 + 2\sum_i (el[i] \times eh[i]) \sqrt{10^{\frac{R}{10}} \sum_i |el[i]|^2 \sum_i |eh[i]|^2}}} \quad \text{(Equation 4)}$$

Multiplier 304 multiplies the low band components of weighted linear prediction residual signal received as input from LPF 294 by the low band amplification coefficient β received as input from low band amplification coefficient calculating section 302, and outputs the multiplying result to adder 306. Here, this multiplying result shows the result of amplifying the low band components of the weighted linear prediction residual signal.

Multiplier 305 multiplies the high band components of weighted linear prediction residual signal received as input from HPF 295 by the high band amplification coefficient α received as input from high band amplification coefficient calculating section 303, and outputs the multiplying result to adder 306. Here, this multiplying result shows the result of amplifying the high band components of the weighted linear prediction residual signal.

Adder 306 adds the multiplying result of multiplier 304 and the multiplying result of multiplier 305, and outputs the addition result to LPC synthesis filter 309. Here, this addition result shows the result of adding the low band components amplified by the low band amplification coefficient β and the high band components amplified by the high band amplification coefficient α, that is, the result of performing high band emphasis processing of the weighted linear prediction residual signal.

Second multiplier coefficient calculating section 307 calculates the coefficient $\gamma_2^j$ by which the linear prediction coefficient of the j-th order is multiplied, as a second multiplier coefficient using the second weighting coefficient $\gamma_2^j$ received as input from weighting coefficient determining section 202, and outputs the result to second weighted LPC calculating section 308. Here, $\gamma_2^j$ is calculated by calculating the j-th power of $\gamma_2$.

Second weighted LPC calculating section 308 multiplies the LPC of the j-th order received as input from LPC decoding section 203 by the second multiplier coefficient $\gamma_2^j$ received as input from second multiplier coefficient calculating section 307, and outputs the multiplying result to LPC synthesis filter 309 as a second weighted LPC.

LPC synthesis filter 309 is a linear prediction filter in which the transfer function is expressed by $Hs(z)=1/(1+a_{j2}\times z^{-j})$, and performs filtering processing of the high-band emphasis-processed weighted linear prediction residual signal, which is received as input from adder 306, and outputs the post filtered speech signal. Here, $a_{j2}$ represents the second weighted LPC of the j-th order received as input from second weighted LPC calculating section 308.

Figure 6:
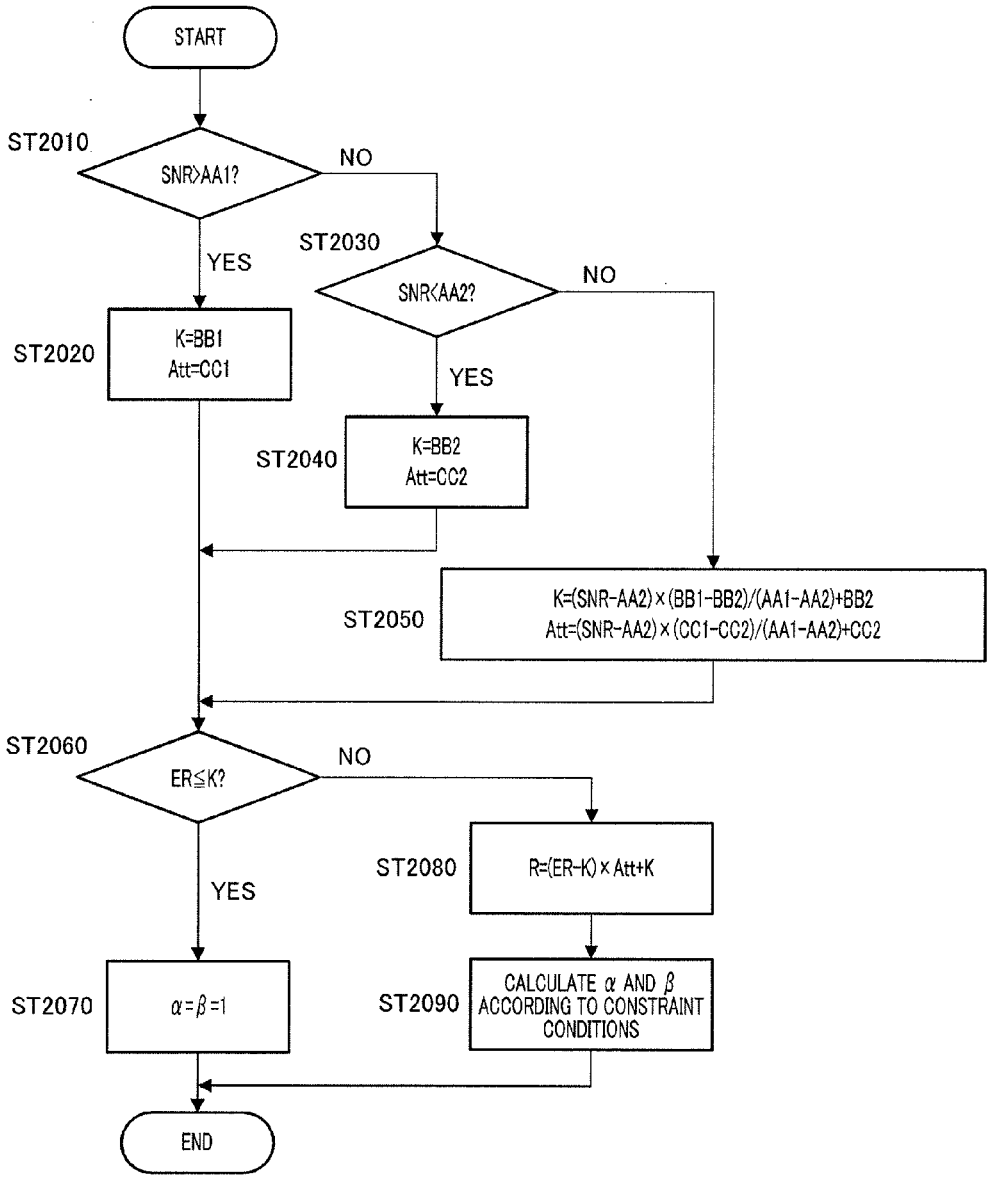
FIG. 6 is a flowchart showing the steps of calculating a high-band emphasis coefficient, low-band amplification coefficient and high-band amplification coefficient according to an embodiment of the present invention.

FIG. 6 is a flowchart showing the steps of calculating the high band emphasis coefficient R, low band amplification coefficient β and high band amplification coefficient α in high band emphasis coefficient calculating section 301, low band amplification coefficient calculating section 302 and high band amplification coefficient calculating section 303, respectively.

First, high band emphasis coefficient calculating section 301 decides whether or not the SNR calculated in SNR calculating section 282 is higher than a threshold AA1 (ST 2010), and, when it is decided that the SNR is higher than the threshold AA1 (i.e. "YES" in ST 2010), sets the value of a variable K to a constant BB1 and the value of a variable Att to a constant CC1 (ST 2020). By contract, when it is decided that the SNR is equal to or lower than the threshold AA1 (i.e. "NO" in ST 2010), high band emphasis coefficient calculating section 301 decides whether or not the SNR is lower than a threshold AA2 (ST 2030). When it is decided that the SNR is lower than the threshold AA2 ("YES" in ST 2030), high band emphasis coefficient calculating section 301 sets the value of the variable K to a constant BB2 and the value of the variable Att to a constant CC2 (ST 2040). By contract, if it is decided that the SNR is equal to or higher than the threshold AA2 (i.e. "NO" in ST 2030), high band emphasis coefficient calculating section 301 sets the values of the variable K and the variable Att according to following equation 5 and equation 6 (ST 2050). As the values of AA1, AA2, BB1, BB2, CC1 and CC2, for example, AA1=7, AA2=5, BB1=3.0, BB2=1.0, CC1=0.625 or 0.7, and CC2=0.125 or 0.2, are suitable.

$$K=(SNR-AA2)\times(BB1-BB2)/(AA1-AA2)+BB2 \quad \text{(Equation 5)}$$

$$Att=(SNR-AA2)\times(CC1-CC2)/(AA1-AA2)+CC2 \quad \text{(Equation 6)}$$

Next, high band emphasis coefficient calculating section 301 decides whether or not the energy ratio ER calculated in energy ratio calculating section 300 is equal to or lower than the value of the variable K (ST 2060). When it is decided that the energy ratio ER is equal to or lower than the value of the variable K in ST 2060 (i.e. "YES" in ST 2060), low band amplification coefficient calculating section 302 sets the low band amplification coefficient β to "1" and high band amplification coefficient calculating section 303 sets the high band amplification coefficient α to "1" (ST 2070). Here, setting the low band amplification coefficient β and high band amplification coefficient α to "1" means that neither the low band components nor high band components of the weighted linear prediction residual signal extracted in LPF 294 and HPF 295 are amplified.

By contrast, when it is decided that the energy ratio ER is higher than the value of the variable K in ST 2060 (i.e. "NO" in ST 2060), high band emphasis coefficient calculating section 301 calculates the high band emphasis coefficient R according to following equation 7 (ST 2080). Equation 7 shows that the level ratio between the low band components and high band components of an excitation signal subjected to high band emphasis processing is at least K, and increases in association with the level ratio before high band emphasis processing. Further, according to processing in high band emphasis coefficient calculating section 301, Att and K increase when the SNR is higher, and decrease when the SNR is lower. Therefore, the lowest value K of the level ratio increases when the SNR is higher, and decreases when the SNR is lower. Here, Att increases when the SNR is higher, increasing the level ratio R subjected to high band emphasis processing, and Att decreases when the SNR is lower, decreasing the level ratio R subjected to high band emphasis processing. When the level ratio is lower, the spectrum approaches to flat and the high band is raised (i.e. emphasized). Therefore, "Att" and "K" function as parameters to control high band emphasis coefficients such that the level of high band emphasis becomes lower when the SNR increases, and becomes higher when the SNR decreases.

$$R=(ER-K)\times Att+K \quad \text{(Equation 7)}$$

Next, low band amplification coefficient calculating section 302 and high band amplification coefficient calculating section 303 calculate the low band amplification coefficient and the high band amplification coefficient a according to equation 3 and equation 4, respectively (ST 2090). Here, equation 3 and equation 4 are derived from two the constraint conditions represented by following equation 8 and equation 9. These two equations have two meanings that the energy of an excitation signal does not change before and after high band emphasis processing and that the energy ratio is R between the low band components and high band components after high band emphasis processing.

[3]

$$\Sigma_i|ex[i]|^2=\Sigma_i|ex'[i]|^2 \quad \text{(Equation 8)}$$

[4]

$$10\log_{10}\beta^2\Sigma_i|el[i]|^2-10\log_{10}\alpha^2\Sigma_i|eh[i]|^2=R \quad \text{(Equation 9)}$$

In equation 8 and equation 9, the excitation signal before high band emphasis processing, ex[i], the excitation signal after high band emphasis processing, ex'[i], the high band component eh[i] of ex[i] and low band component el[i] of ex[i] hold the relationships shown in following equation 10 and equation 11.

$$ex[i]=eh[i]+el[i] \quad \text{(Equation 10)}$$

$$ex'[i]=\alpha\times eh[i]+\beta\times el[i] \quad \text{(Equation 11)}$$

Therefore, equation 8 and equation 9 are equivalent to following equation 12 and equation 13, respectively, and these equations derive equation 3 and equation 4.

[5]

$$\Sigma_i|ex[i]|^2=\alpha^2\Sigma_i|eh[i]|^2+\beta^2\Sigma_i|el[i]|^2+2\alpha\beta\Sigma_i(eh[i]\times el[i]) \quad \text{(Equation 12)}$$

[6]

$$\beta=\alpha\times 10^{\frac{R}{20}}\sqrt{\frac{\sum_i|eh[i]|^2}{\sum_i|el[i]|^2}} \quad \text{(Equation 13)}$$

Figure 7:
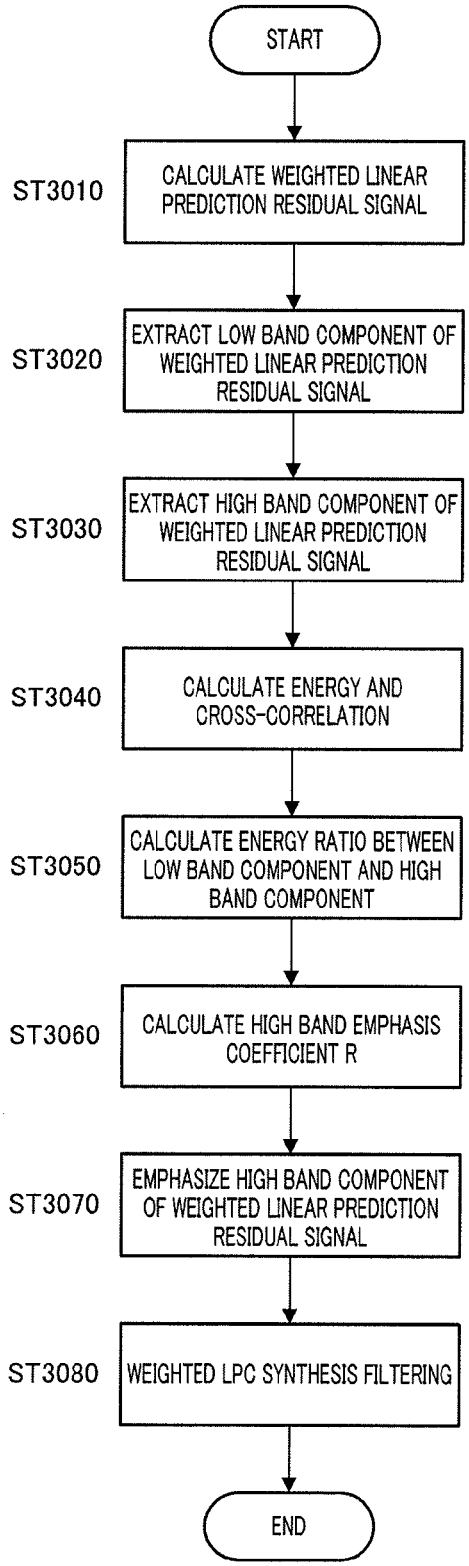
FIG. 7 is a flowchart showing the main steps of post filtering processing in a post filter according to an embodiment of the present invention.

FIG. 7 is a flowchart showing the main steps of post filtering processing in post filter 209.

In ST 3010, LPC inverse filter 293 acquires a weighted linear prediction residual signal by performing LPC synthesis filtering processing of the decoded speech signal received as input from LPC synthesis filter 205.

In ST 3020, LPF 294 extracts the low band components of the weighted linear prediction residual signal.

In ST 3030, HPF 295 extracts the high band components of the weighted linear prediction residual signal.

In ST 3040, first energy calculating section 296, second energy calculating section 297, third energy calculating section 298 and cross-correlation calculating section 299 calculate the energy of the low band component of the weighted linear prediction residual signal, the energy of the high band component of the weighted linear prediction residual signal, the energy of the weighted linear prediction residual signal and the cross-correlation between the low band components and high band components of the weighted linear prediction residual signal, respectively.

In ST 3050, energy ratio calculating section 300 calculates the energy ratio ER between the low band components and high band components of the weighted linear prediction residual signal.

In ST 3060, high band emphasis coefficient calculating section 301 calculates the high band emphasis coefficient R using the SNR calculated in SNR calculating section 208 and the energy ratio ER calculated in energy ratio calculating section 300.

In ST 3070, adder 306 adds the low band components amplified in multiplier 304 and the high band components amplified in multiplier 305, to acquire a high-band emphasized weighted linear prediction residual signal.

In ST 3080, LPC synthesis filter 309 acquires a post-filtered speech signal, by performing LPC synthesis filtering of the high-band emphasized weighted linear prediction residual signal.

Here, in the steps of post filtering shown in FIG. 7, for example, as shown in ST 3020 and ST 3030, if the order of processing can be switched or these processing can be performed concurrently, it is possible to change the steps of post filtering processing accordingly.

Thus, according to the present embodiment, the speech decoding apparatus calculates coefficients for high band emphasis processing of a weighted linear prediction residual signal based on the SNR of a decoded speech signal and performs post filtering, thereby adjusting the level of high band emphasis according to the magnitude of the background noise level.

Also, an example case has been described with the present embodiment where weighting coefficient determining section 202 calculates the first weighting coefficient $\gamma 1$ and second weighting coefficient $\gamma 2$ based on bit rate information. However, the present invention is not limited to this, and, for example, scalable coding may use information similar to bit rate information instead of bit rate information, such as layer information showing encoded data of which layers are included in encoded data transmitted from the speech encoding apparatus. Also, bit rate information or similar information may be multiplexed with encoded data received as input in demultiplexing section 201, may be separately received as input by demultiplexing section 201 or may be determined and generated inside demultiplexing section 201. Further, it is also possible to employ a configuration in which bit rate information or similar information is not outputted from demultiplexing section 201 and in which weighting coefficient determining section 202 is eliminated. In this case, a weighting coefficient is a predetermined fixed value.

Also, an example case has been described with the present embodiment where power calculating section 206 calculates the power of a decoded speech signal. However, the present invention is not limited to this, and power calculating section 206 may calculate the energy of a decoded speech signal. The energy can be acquired by eliminating the calculation of the average value per sample. Also, although power is calculated by $10 \log_{10} X$, it can be calculated by $\log_{10} X$ with corresponding re-designed threshold and others. It is also possible to design a variation in the linear domain without using logarithm.

Also, an example case has been described with the present embodiment where mode deciding section 207 decides the mode of a decoded speech signal. However, the speech encoding apparatus may encode mode information by analyzing the features of an input speech signal, and transmit the result to the speech decoding apparatus.

Also, an example case has been described with the present embodiment where the speech decoding apparatus according to the present embodiment receives and processes speech encoded data transmitted from the speech encoding apparatus according to the present embodiment. However, the present invention is not limited to this, and the essential requirement of speech encoded data that is received and processed by the speech decoding apparatus according to the present embodiment, is to be outputted from a speech encoding apparatus that can generate speech encoded data that can be processed by the speech decoding apparatus.

An embodiment of the present invention has been described above.

The speech decoding apparatus according to the present invention can be mounted on a communication terminal apparatus and base station apparatus in mobile communication systems, so that it is possible to provide a communication terminal apparatus, base station apparatus and mobile communication systems having the same operational effect as above.

Although a case has been described with the above embodiments as an example where the present invention is implemented with hardware, the present invention can be implemented with software. For example, by describing the speech encoding/decoding method according to the present invention in a programming language, storing this program in a memory and making the information processing section execute this program, it is possible to implement the same function as the speech encoding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2007-053531, filed on Mar. 2, 2007, including the specification, drawings and abstract, is incorporated herein by reference in its entirety.

INDUSTRIAL APPLICABILITY

The speech decoding apparatus and speech decoding method of the present invention are applicable to shaping of quantized noise in speech codec, and so on.

The invention claimed is:

1. A speech decoding apparatus comprising:

a speech decoder that decodes encoded data acquired by encoding a speech signal to acquire a decoded speech signal;

a mode deciding processor that decides, at regular intervals, whether or not a mode of the decoded speech signal comprises a stationary noise period;

a power calculator that calculates a power of the decoded speech signal;

a signal to noise ratio (SNR) calculator that calculates a SNR of the decoded speech signal using a mode decision result of the mode deciding processor and the power of the decoded speech signal; and a post filter that performs post filtering processing including high band emphasis processing of an excitation signal, using the SNR, wherein the high band emphasis processing is performed such that a level of high band emphasis becomes higher when the SNR decreases.

2. The speech decoding apparatus according to claim 1, wherein the post filter comprises:

a linear prediction coefficient (LPC) inverse filter that performs LPC inverse filtering processing of the decoded speech signal to acquire a linear prediction residual signal;

a high band emphasis coefficient calculator that calculates a high band emphasis coefficient using the SNR;

an amplification coefficient calculator that calculates a low band amplification coefficient and high band amplification coefficient using the high band emphasis coefficient;

a high band emphasis processor that acquires a linear prediction residual signal subjected to high band emphasis by adding a low band amplification signal, acquired by amplifying a low band component of the linear prediction residual signal using the low band amplification coefficient, and a high band amplification signal, acquired by amplifying a high band component of the linear prediction residual signal using the high band amplification coefficient; and a LPC synthesis filter that performs LPC synthesis filtering processing of the linear prediction residual signal subjected to high band emphasis.

3. The speech decoding apparatus according to claim 2, wherein energy of the decoded speech signal after the high band emphasis processing is same as energy of the decoded speech signal before the high band emphasis processing.

4. The speech decoding apparatus according to claim 2, wherein the decoded speech signal includes low band components and high band components;

the high band emphasis coefficient is an energy ratio of the high band components to the low band components after the high band emphasis processing; and the high band emphasis coefficient increases when the SNR is higher.

5. A speech decoding method performed by a processor comprising:

decoding encoded data acquired by encoding a speech signal to acquire a decoded speech signal;

deciding, at regular intervals, whether or not a mode of the decoded speech signal comprises a stationary noise period;

calculating a power of the decoded speech signal;

calculating a signal to noise ratio (SNR) of the decoded speech signal using a mode decision result of the mode deciding section and the power of the decoded speech signal; and performing post filtering processing including high band emphasis processing of an excitation signal, using the SNR, wherein the high band emphasis processing is performed such that a level of high band emphasis becomes higher when the SNR decreases.

* * * * *